US005660460A

United States Patent [19]

McLeod, Jr.

[11] Patent Number: 5,660,460

[45] Date of Patent: Aug. 26, 1997

[54] PORTABLE LIGHTING SYSTEM

[76] Inventor: Edward Stephen McLeod, Jr., 1789 Union Ave., Niceville, Fla. 32578

[21] Appl. No.: 607,878

[22] Filed: Feb. 27, 1996

[51] Int. Cl.[6] ..... F21L 15/08

[52] U.S. Cl. ..... 362/103; 362/105; 362/106; 362/287; 362/427

[58] Field of Search ..... 362/20, 103, 105, 362/106, 187, 188, 190, 191, 197, 287, 372, 396, 418, 427

[56] References Cited

U.S. PATENT DOCUMENTS

| | | | |
|---|---|---|---|
| 1,900,906 | 3/1933 | Brown | 362/105 |
| 1,904,902 | 4/1933 | Pratt | 362/105 |
| 4,399,492 | 8/1983 | Kolesar | 362/106 |
| 4,631,644 | 12/1986 | Dannhayer | 362/105 |
| 4,916,594 | 4/1990 | Headley | 362/108 |
| 4,916,596 | 4/1990 | Sharrah et al. | 362/187 |
| 5,272,606 | 12/1993 | Blaney | 362/20 |
| 5,463,538 | 10/1995 | Womack | 362/106 |

*Primary Examiner*—Ira S. Lazarus
*Assistant Examiner*—Alfred Basichas
*Attorney, Agent, or Firm*—Joseph N. Breaux

[57] ABSTRACT

A portable lighting system of the type attachable to an article of clothing of a user is provided. The lighting system includes: a housing attachable to an article of clothing of a user having a light source mounted within a reflector for projecting a light beam; a focusing assembly mounted within the housing and connected to the reflector for allowing the user to focus the projected light beam to a desired sharpness; a battery pack attachable to an article of clothing of a user containing a plurality of battery sets; a power cord in connection between the battery pack and the light source; and a switch electrically connected between the battery sets and the light source for allowing the user to separately, select any one of the battery sets to power the light source.

2 Claims, 1 Drawing Sheet

PORTABLE LIGHTING SYSTEM

TECHNICAL FIELD

The present invention relates to portable lighting devices and more particularly to portable lighting devices that are attachable to a user and have multiple battery sets.

BACKGROUND ART

Innumerable applications require the use of a lightweight, portable light source. For example, mechanics are often faced with the problem of insufficient lighting in the inspection of the underside or internal regions of a vehicle, which difficulty has heretofore been addressed by the use of clumsy hanging lights which suffer from their need for a hook or bracket for attachment and which also create undesirable shadows. In addition, these lights often, because of their size, have to be placed in a position in which they blind the user.

Maintenance personnel have also been faced with the inconvenience of available portable light sources in their inspection and maintenance of equipment, passageways, access panels and the like which a generally unlighted. Sportsmen, e.g., backpackers, spelunkers, hunters and fishermen have also expressed a need for a portable light source since it is often impossible or impractical to carry a hand held flashlight-type light source. Heretofore, these users have relied on hand held flashlights or head mounted light sources. Obviously, hand held flashlights are often impractical if not impossible to effectively use. One problem with head mounted light sources is that the user must turn his head in the direction he wishes the light source to be directed. A second problem with head mounted light sources is that at night the light may cause the user's eyes to constrict thereby decreasing his vision in the surrounding darkness.

An additional problem with the previously mentioned devices is when the power supply, e.g., batteries, is exhausted while the user is involved in an activity. When this happens the user has to cease the activity being performed and replace the power supply, if replacements are readily available.

It would be a benefit, therefore, to have a portable lighting system that has a light assembly attachable to a user's clothing. It would be a further benefit to have a light assembly that is rotatable about the point of attachment to the user's clothing. It would be a still further benefit to have a light assembly wherein the sharpness of the projected light beam may be focused. It would be an additional benefit, to provide a battery pack that has a plurality of individual battery sets.

GENERAL SUMMARY DISCUSSION OF INVENTION

It is thus an object of the invention to provide a portable lighting system that has a light assembly attachable to an article of clothing of a user.

It is a further object of the invention to provide a portable lighting system that has a light assembly which is rotatable about the point of attachment to the user's clothing.

It is a still further object of the invention to provide a portable lighting system that has a focusing assembly for adjusting the sharpness of the projected light beam.

It is a still further object of the invention to provide a portable lighting system that has a battery pack attachable to the user having a plurality of individually selectable battery sets for powering the light source.

Accordingly, a portable lighting system of the type attachable to an article of clothing of a user is provided. The lighting system includes: a housing attachable to an article of clothing of a user having a light source mounted within a reflector for projecting a light beam; a focusing assembly mounted within the housing and connected to the reflector for allowing the user to focus the projected light beam to a desired sharpness; a battery pack attachable to an article of clothing of a user containing a plurality of battery sets; a power cord in connection between the battery pack and the light source; and a switch electrically connected between the battery sets and the light source for allowing the user to separately, select any one of the battery sets to power the light source.

The housing is constructed of a durable, rigid material such as a metal or plastic. The housing may be circular or rectangular in shape. Preferably, the housing is compact and lightweight.

A swivel connector is connected to an outer surface of the housing for attaching the connector to an article of clothing of the user. The swivel connector may be a clasp or clip type connector so that the housing may be securely connected to clothing, head bands and eyeglasses.

The reflector may be shaped conically or parabolically. The reflector is constructed of a resilient, flexible material such as a plastic, rubber or metal. The reflector has a coated inner surface for projecting the light emitted from the light source. The inner surface of the reflector may be coated with a matte metallic finish or paint. The inner surface may have a high sheen metallic coating, e.g., chromium coating.

The focusing assembly includes a substantially conical reflector guide mounted within the housing having a narrow end and a wide end. The reflector is movably mounted within the reflector guide. A spring is connected between the narrow end of the reflector guide and the reflector urging the reflector toward the narrow end. A cam follower is connected to the reflector and extends outwardly from the reflector and is disposed through a slot running substantially the length of the guide. A cam is in operational contact with the cam follower. The cart is connected to a knob located exterior of the housing by a shaft so that the user may rotate the cam moving the reflector within the reflector guide.

The battery pack contains a plurality of battery sets. Each of the battery sets is sufficient to power the light source. A battery set may be any type of battery, or number of batteries required to operate the chose light source. The battery pack is connected to the light source by a power cord.

The switch is a multiple contact switch having at least one contact that allows the user to cut power to the light source. Each of the other contacts provides a circuit from a single battery set to the light source.

BRIEF DESCRIPTION OF THE DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
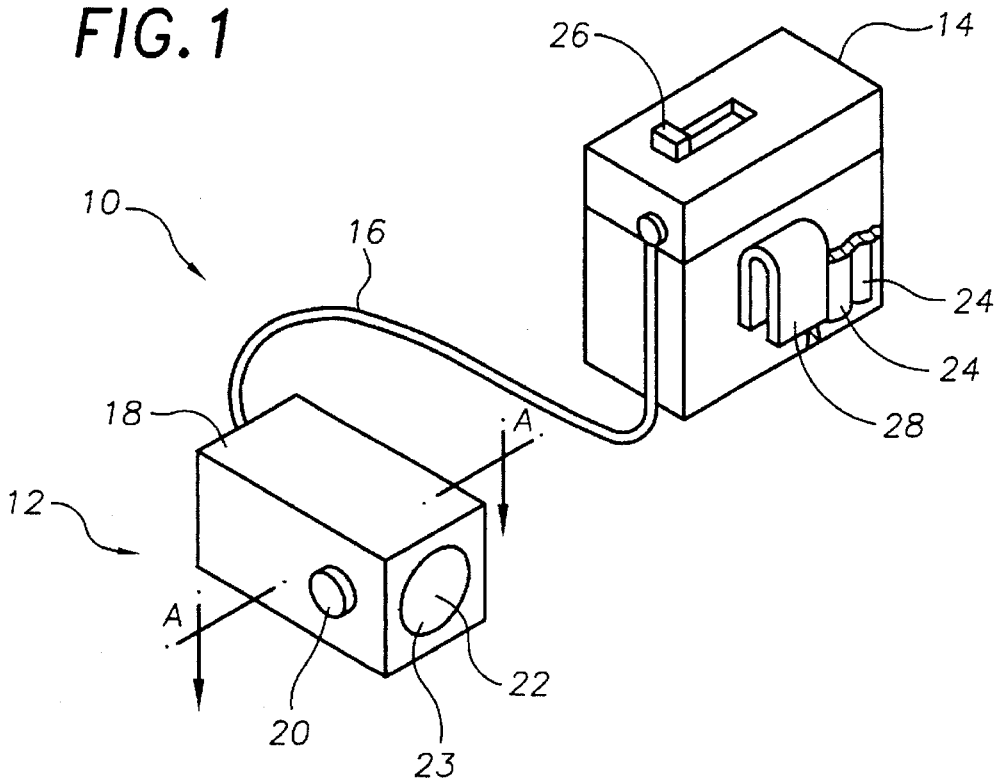
FIG. 1 is a perspective view of an exemplary embodiment of a portable lighting system of the present invention.

FIG. 1 is a perspective view of an exemplary embodiment of a portable lighting system of the present invention generally designated by the numeral 10. Lighting system 10 includes a light assembly 12, a battery pack 14 and a power cord 16.

Lighting assembly 12 includes a substantially rectangular housing 18. Housing 18 includes a light source 22 mounted within a reflector 23 for projecting a light beam. Knob 20 controls a focusing assembly (see FIG. 2) mounted within housing 18 and connected to reflector 23. The focusing assembly operated by knob 20 is provided for allowing a user to focus the light beam projected by a light source 22 to a desired sharpness.

Battery pack 14 is electrically connected to light source 22 by power cord 16. Pack 14 contains four battery sets 24, each battery set 24 being sufficient to power light assembly 12. A switch 26 is electrically connected between battery sets 24 and light source 22 for allowing a user to separately, select any battery set 24 to power light source 22. A U-shaped first connector 28 is rigidly connected to battery pack 14 for attaching battery pack 14 to the clothing of a user such as a belt or waistband.

Figure 2:
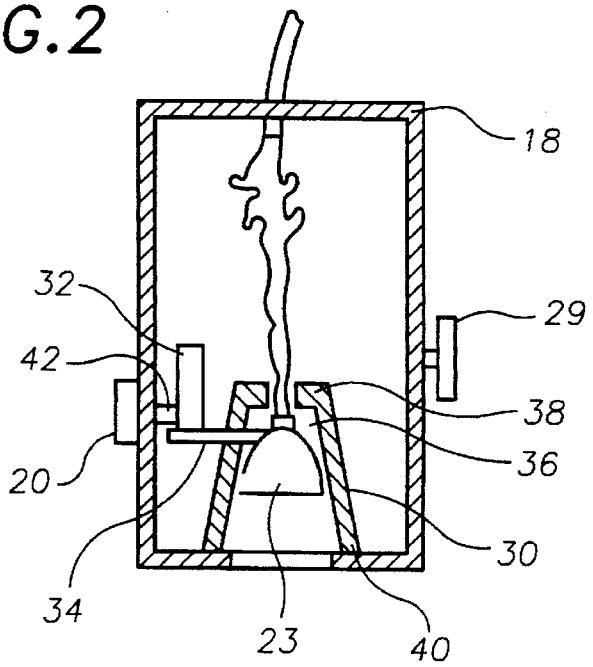
FIG. 2 is a cross-sectional view of the lighting assembly along the line A—A of FIG. 1.

FIG. 2 is a cross-sectional view of lighting assembly 12 along the line A—A of FIG. 1. A swivel connector 29 is connected to housing 18 for rotatably attaching housing 18 to an article of clothing of a user such as a belt, cap or eyeglasses. With swivel connector 29 attached to a user, lighting assembly may be rotated in 360 degrees relative to the point of attachment to the user's clothing. The construction of swivel connector 29 is essentially identical to that of first connector 28.

The focusing assembly of lighting assembly 12 includes reflector 23, a reflector guide 30, a cam 32, a cam follower 34, a pair of springs 36 and knob 20. Reflector 23 is constructed in a parabolic shape of a resilient, flexible material. Reflector 23 is movably mounted within reflector guide 30. Reflector guide 23 is a substantially conical member, having a narrow end 38 and a wide end 40. Guide 23 is rigidly mounted within housing 18. A pair of springs 36 are connected between narrow end 38 and reflector 23 urging reflector 23 towards narrow end 38.

Knob 20 is connected to cam 32 by a shaft 42 disposed through a wall of housing 18. Shaft 42 is connected offset from the center of cam 32. Cam 32 is in operational contact with cam follower 34 which extends outwardly from reflector 23. "Operational contact" is defined to mean that cam follower 34 remains in contact with the perimeter of cam 32 while cam 32 is rotated as well as when. stationary.

Use of portable lighting system 10 is now described with reference to FIGS. 1 and 2. Battery pack 14 is attached to the user's waistband (not shown), power cord 16 is wrapped around the user's back and attached to the user's waistband. With light source 22 powered by a first selected battery set 24, the user may rotate light assembly 12 so that the light beam is projected in the desired direction. The user may then adjust the width of the light beam by turning knob 20 which rotates cam 32. As cam 32 makes a full revolution reflector 23 is moved from narrow end 38 of reflector guide 30 to wide end 40 and back again. As reflector 23 is moved towards wide end 40, reflector 23 expands creating a wider light beam, as reflector 23 moves toward narrow end 38 reflector 23 is constricted within guide 30 focusing the light beam. When the power from the first selected battery set 24 is exhausted the user selects a second battery set 24 via switch 26.

It can be seen from the preceding description that a portable lighting source which has a light assembly attachable to an article of clothing of a user, a light assembly which is rotatable about the point of attachment to the user's clothing, a focusing assembly for adjusting the sharpness of the projected light beam, and that has a battery pack attachable to the user having a plurality of separately, selectable battery sets for powering the light source has been provided.

It is noted that the embodiment of the portable lighting system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A portable lighting system comprising:

a housing attachable to an article of clothing of a user, said housing including a light source mounted within a reflector for projecting a light beam;

a focusing assembly mounted within said housing and connected to said reflector for allowing said user to focus the projected light beam to a desired sharpness, said focusing assembly including:

a substantially conical reflector guide mounted within said housing having a narrow end and a wide end, said reflector being movably mounted within said reflector guide;

a spring connected between said narrow end of said reflector guide and said reflector urging said reflector toward said narrow end;

a cam follower extending outwardly from said reflector;

a cam in operational contact with said cam follower; and a knob in connection with said cam in a manner such that said user may rotate said cam moving said reflector within said reflector guide;

a battery pack attachable to an article of clothing of a user containing a plurality of battery sets;

a power cord in connection between said battery pack and said light source; and a switch electrically connected between said battery sets and said light source for allowing said user to separately, select any of said battery sets to power said light source.

2. A portable lighting system comprising:

a housing rotatably attachable to an article of clothing of a user, said housing including a light source mounted within a reflector for projecting a light beam;

a focusing assembly mounted within said housing and connected to said reflector for allowing said user to focus said light beam to a desired sharpness, said focusing assembly comprising;

a substantially conical reflector guide mounted within said housing having a narrow end and a wide end, said reflector being movably mounted within said reflector guide;

a spring connected between said narrow end of said reflector guide and said reflector urging said reflector toward said narrow end;

a cam follower extending outwardly from said reflector;

a cam in operational contact with said cam follower; and a knob in connection with said cam in a manner such that said user may rotate said cam moving said reflector within said reflector guide;

a battery pack attachable to an article of clothing of a user containing a plurality of battery sets;

a power cord in connection between said battery pack and said light source; and a switch electrically connected between said battery sets and said light source for allowing said user to separately, select any of said battery set to power said light source.

* * * * *